US005255402A

United States Patent [19]

Kashani

[11] Patent Number: 5,255,402

[45] Date of Patent: Oct. 26, 1993

[54] FASTENING ASSEMBLY FOR A SINK TRAP HAVING A REMOVABLE BOTTOM PORTION

[75] Inventor: Hooshang Kashani, San Juan Capistrano, Calif.

[73] Assignee: Cashew Consulting, Inc., Irvine, Calif.

[21] Appl. No.: 840,454

[22] Filed: Feb. 24, 1992

[51] Int. Cl.[5] ..... E03C 1/284

[52] U.S. Cl. ..... 4/679; 24/336

[58] Field of Search ..... 4/679, DIG. 14; 24/336; 137/247.51, 247.49, 247.41

[56] References Cited

U.S. PATENT DOCUMENTS 3,935,602 2/1976 Kale ..... 4/292
4,230,582 10/1980 Tuleja ..... 137/247.51
5,095,553 3/1992 Vosper ..... 4/679

FOREIGN PATENT DOCUMENTS 2756243 7/1979 Fed. Rep. of Germany ..... 4/679

*Primary Examiner*—William A. Cuchlinski, Jr.
*Assistant Examiner*—W. Morris Worth
*Attorney, Agent, or Firm*—Hawes & Fischer

[57] ABSTRACT

A trap for a sink, or the like, having an easily removable bottom portion by which to permit the trap to be cleaned and lost articles removed. The bottom portion of the trap is detachably connected to a dip portion by a plurality of locking clips. The dip portion includes a plurality of locking receptacles and the bottom portion includes a plurality of locking tabs that are axially aligned with respective locking receptacles. Each locking clip extends between an axially aligned receptacle and tab so as to apply a clamping force to the trap to prevent the separation of the bottom portion from the dip portion. The locking clips may be removed from the trap, whereby the trap may be opened without any special tools or plumbing skills.

9 Claims, 2 Drawing Sheets

FASTENING ASSEMBLY FOR A SINK TRAP HAVING A REMOVABLE BOTTOM PORTION

BACKGROUND OF THE INVENTION

1. Field of the Invention

This invention relates to a trap of the type that is typical of the plumbing associated with a sink, tub, wash stand, or the like. Said trap has a removable bottom portion to permit the user who is without special tools or plumbing skills to easily clean said bottom portion of debris and/or remove lost articles therefrom.

2. Background Art

Traps have long been used with plumbing fixtures that carry waste water from a sink, or the like, to a suitable disposal site. From time to time, it may be necessary to open the trap to remove debris that has accumulated therein. Such debris is known to block the plumbing and thereby cause waste water to back up into the sink. On other occasions, access to the trap is necessary to remove a valuable article that has come to rest therein after being inadvertently dropped down the drain. One solution to the aforementioned problems has been to run a snake through the plumbing to break up the blockage. Another solution is to call a plumber to manually open the trap so as to remove the debris or lost article therefrom. However, the foregoing solutions may prove to be both expensive and time consuming, because gaining access to the trap is often difficult. Such difficulty is magnified when a workman is subjected to the cramped quarters that are commonly found below a sink top.

It would therefore be desirable to have a reliable means by which to permit the average homeowner to quickly and easily open a trap from a plumbing fixture so that the trap may be cleaned and lost articles removed without requiring special tools or plumbing skills.

An example of a trap having a removable bottom or closure member is available by referring to U.S. Pat. No. 3,935,602 issued Feb. 3, 1976.

SUMMARY OF THE INVENTION

In general terms, a trap is disclosed for use with a sink, or the like, having a U-shaped dip portion and a bottom portion that are detachably connected together. By detaching the bottom portion from the dip portion, the trap may be quickly and easily opened to permit debris and other articles to be removed therefrom. More particularly, a pair of locking receptacles are formed at each side of the dip portion. Each receptacle has a horizontally extending window which communicates with a vertically extending slot. A pair of locking tabs is formed at each side of the bottom portion and axially aligned with respective locking receptacles from the dip portion of the trap. With the dip an bottom portions snap-fit together, a locking clip is connected between a locking receptacle and an axially aligned locking tab so as to apply a clamping force to the trap to prevent the inadvertent detachment of the bottom portion from the dip portion.

More particularly, each locking clip includes a U-shaped head which is sized so as to be received within the vertical slot of a corresponding locking receptacle. A finger projects laterally from the head for receipt within the horizontal window of the locking receptacle to secure the head thereat. Each locking clip also includes a flat base, one end of which is adapted to be rotated into detachable engagement with an axially aligned locking tab. Thus, the locking clip extends between and axially aligned receptacle and locking tab to prevent the inadvertent separation of the bottom portion from the dip portion of the trap. However, by lifting the locking clips out of engagement with the axially aligned locking receptacles and locking tabs, the bottom portion of the trap may be pulled downwardly and out of connection with the dip portion, whereby said trap can be opened for cleaning and inspection purposes.

DETAILED DESCRIPTION

Figure 1:
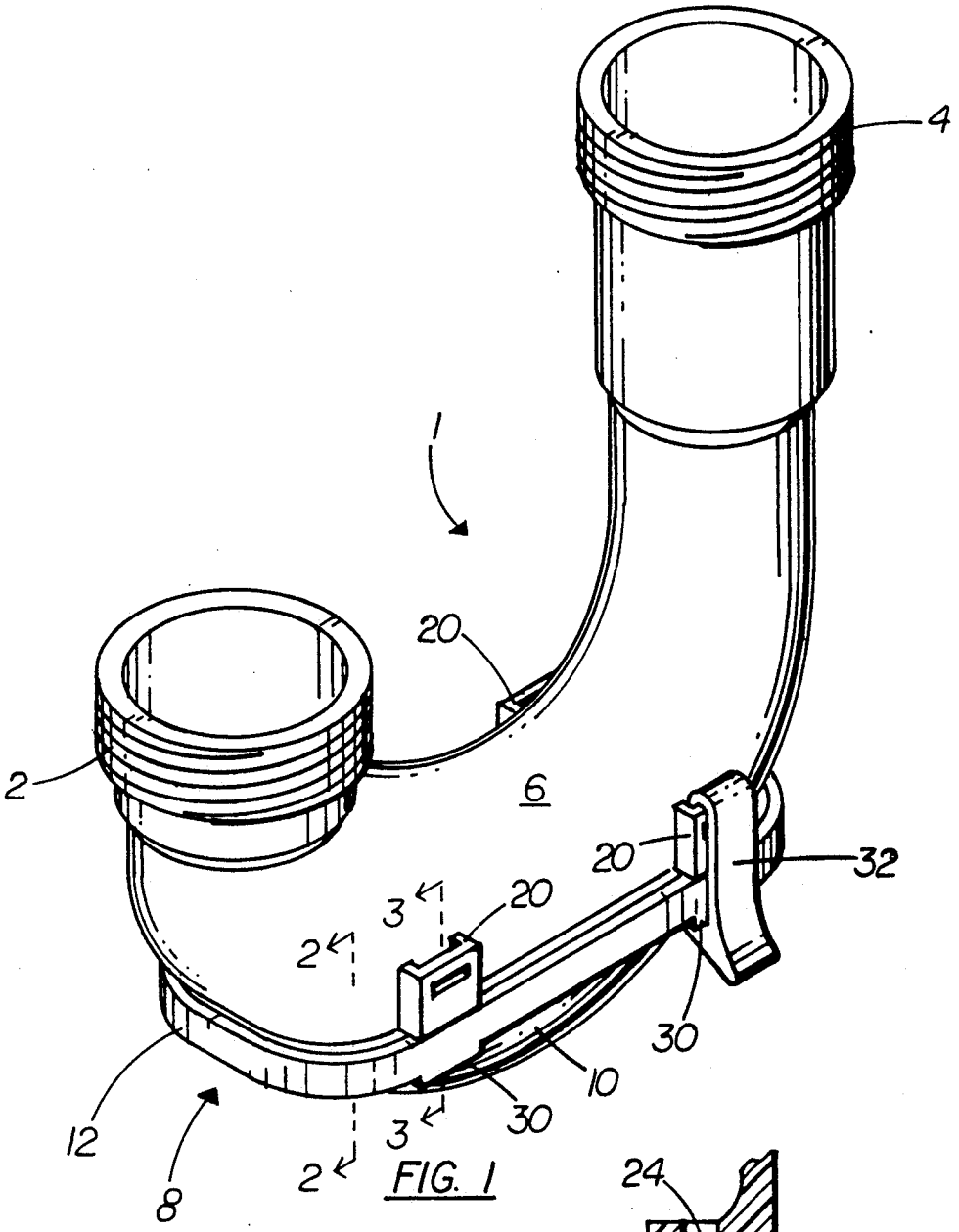
FIG. 1 is a perspective view of the trap which forms the present invention with dip and bottom portions detachably connected together.

The trap 1 which forms the present invention is best described while referring to the drawings. FIG. 1 shows the trap 1 disassociated from the conventional plumbing that is normally found in combination with a sink or the like which receives and conveys waste water. As will be understood by those skilled in the art, the trap 1 includes screw fittings 2 and 4 that are adapted to be coupled to respective inlet and outlet pipes (not shown) at a location below the sink. Similarly, the trap 1 includes the usual U-shaped dip portion 6 fluidically coupled between the inlet and outlet screw fittings 2 and 4.

Figure 2:
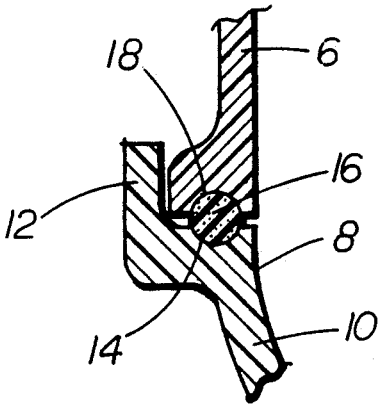
FIG. 2 is a cross-section taken along lines 2—2 of FIG. 1.

In accordance with the present invention, trap 1 also includes a bottom portion 8 that is detachably connected to the dip portion 6. As will now be described while referring concurrently to FIGS. 1 and 2, the bottom portion 8 of trap 1 includes a tub-shaped tray 10 having a peripheral lip 12 projecting outwardly from and extending around the top thereof. A groove 14 is formed within the peripheral lip 12. Located within the groove 14 of lip 12 is a conventional O-ring seal 16. A complementary groove 18 is formed within the dip portion 6 in opposing alignment with the groove 14 of lip 12. Therefore, in the assembled relationship (of FIG. 1), the O-ring 16 will be received within each of the opposing grooves 14 and 18 of bottom portion 8 and dip portion 6 to provide a suitable sealing surface at the interface of said dip and bottom portions 6 and 8.

Figure 3:
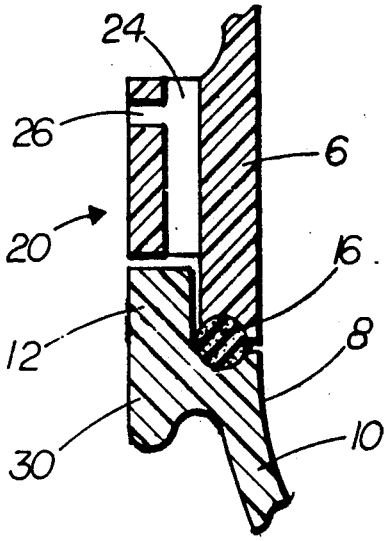
FIG. 3 is a cross-section taken along lines 3—3 of FIG. 1.
Figure 4:
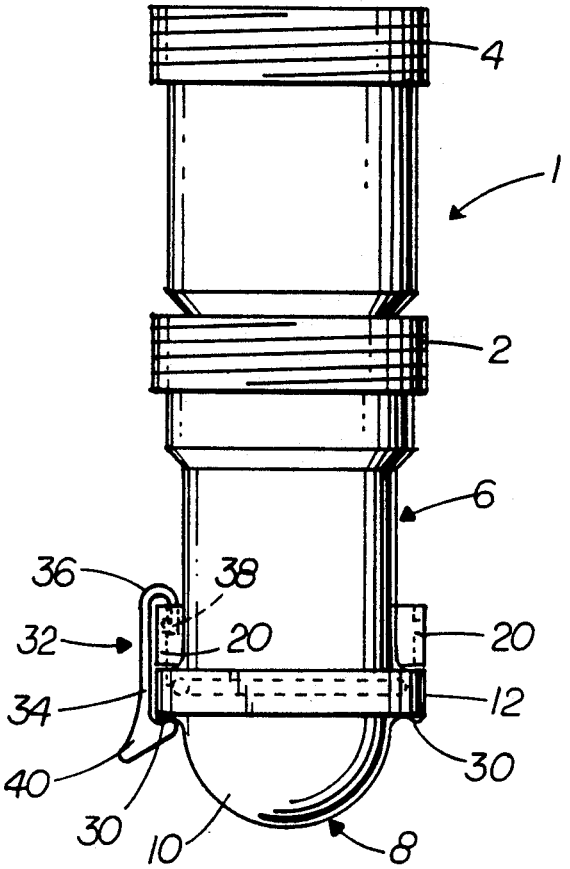
FIG. 4 is an end view of the trap of FIG. 1.
Figure 5:
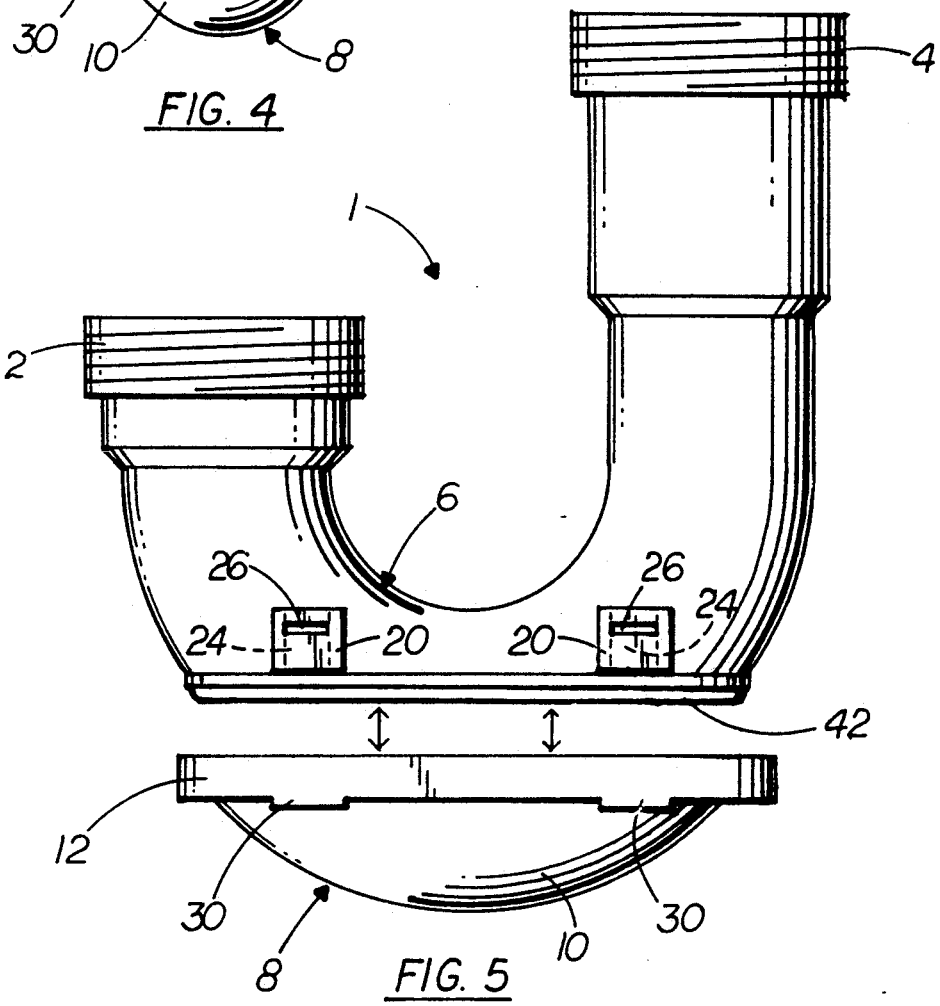
FIG. 5 is a side view of the trap with the bottom portion detached from the dip portion, whereby to open the trap.

Referring now to FIGS. 3-5 of the drawings, a pair of locking receptacles 20 are spaced from one another at each side of the trap 1. More particularly, and as is best shown in FIG. 3, the locking receptacles 20 are coextensively connected (e.g. molded) to opposite sides of the dip portion 6. Each locking receptacle 20 includes a vertically extending slot 24 and a horizontally extending window 26 that intersect one another.

Pairs of spaced locking tabs 30 are coextensively connected (e.g. molded) to opposite sides of the bottom portion 8 of trap 1 below respective locking receptacles 20. That is to say, and in the assembled relationship of FIGS. 1 and 4, the locking receptacles 20 at one side of dip portion 6 are axially (i.e. longitudinally) aligned with respective locking tabs 30 at the identical side of bottom portion 8. Likewise, the locking receptacles 20 at the opposite side of dip portion 6 are axially aligned with respective locking tabs 30 at the identical opposite side of bottom portion 8.

Referring once again to FIG. 3, each locking tab 30 projects downwardly from and is integral with the peripheral lip 12 of bottom portion 8. The width of each locking tab 30 preferably corresponds with the width of the respective locking receptacle 20 thereabove.

Figure 6:
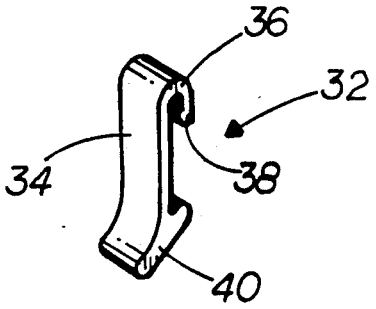
FIG. 6 is a perspective view of a locking clip which is used to detachably and reliably connect the bottom portion to the dip portion, whereby to close the trap.

By virtue of the pairs of locking receptacles 20 and axially aligned locking tabs 30, the bottom portion 8 of trap 1 may be reliably and detachably connected to the dip portion 6. In this regard and in accordance with another aspect of the present invention which is described while referring to FIG. 6 of the drawings, locking clips 32 are provided to cooperate with an axially aligned locking receptacle 20 and locking tab 30 to facilitate the connection and removal of bottom portion 8 relative to dip portion 6. More particularly, each locking clip 32 includes a vertically extending body 34 having a U-shaped head 36 at one end thereof. A locking finger 38 projects inwardly towards body 34 from the free end of the head 36. The opposite end of body 34 terminates at a base 40. The base 40 of locking clip 32 slopes upwardly at a angle of approximately 30 degrees relative to the horizontal.

The method for detachably connecting the bottom portion 8 to the dip portion 6 of trap 1 is now described while referring to FIGS. 1, 3, 4 and 5 of the drawings. The bottom portion 8 is initially moved upwardly and into contact with the dip portion 6, such that the peripheral lip 12 of bottom portion 8 is mated (i.e. snap-fit) to a suitably sized peripheral flange 42 (best shown in FIG. 5) which extends around the opposing bottom edge of dip portion 6. A locking clip 32 is then interconnected between each axially aligned receptacle 20 of dip portion 6 and locking tab 30 of bottom portion 8. As is best shown in FIGS. 3 and 4, the head 36 of clip 32 turns into the vertical slot 24 of locking receptacle 20 such that the locking finger 38 of clip 32 extends into the horizontal window 26 of receptacle 20 to hold said clip in place. Moreover, the body 34 of locking clip 32 extends below the peripheral lip 12 of bottom portion 8 such that the upper-most end of base 40 engages the locking tab 30 which projects downwardly from said peripheral lip 12. Thus, with the locking clips 32 extending from the locking receptacles 20 of dip portion 6 to the axially aligned locking tabs 30 of bottom portion 8, a plurality of clamping forces are applied to the trap 1 so as to prevent the inadvertent detachment of bottom portion 8 from dip portion 6.

However, should the tray 10 of dip portion 8 collect debris, lost articles, or the like, such that it is desirable that said tray be cleaned, the bottom portion 8 may be easily removed from the dip portion 6. More particularly, each locking clip 32 is grasped at the lower-most end of base 40 and a pulling force is applied thereto t detach the upper-most end of base 40 from its mating engagement with the locking tab 30 of bottom portion 8. The locking clip 32 is then rotated upwardly relative to the locking receptacle 20 until the locking finger 38 of head 36 is removed from the window 26 and slot 24 of locking receptacle 20. In this manner, each of the locking clips 32 can be separated from trap 1, whereby to eliminate the aforementioned clamping forces that were applied between dip portion 6 and bottom portion 8. Accordingly, bottom portion 8 may be pulled downwardly relative to dip portion 6 so as to break the previous snap-fit connection therebetween (best shown in FIG. 5). The user will then have access to bottom portion 8 so as to either clean and/or remove any items collected in the tray 10 thereof. Once the tray 10 has been properly serviced, it is a relatively quick and simple task to reconnect the bottom portion 8 to the dip portion 6 by means of locking clips 32 by reversing the method described above.

It will be apparent that while a preferred embodiment of the invention has been shown and described, various modifications and changes may be made without departing from the true spirit and scope of the invention. For example, the trap 1, comprising dip and bottom portions 6 and 8, as well as the locking receptacles 20, locking tabs 30 and locking clips 32 may be made from any lightweight, commercially available plastic material and molding process. However, the particular material and process by which the trap 1 is manufactured is not to be regarded as a limitation of the present invention.

Having thus set forth a preferred embodiment of the present invention, what is claimed is:

1. For use with a sink trap having an upper dip portion and a bottom portion detachably connected to said dip portion, fastening means by which to releasably attach said bottom portion to said dip portion, said fastening means comprising:

a first catch located at said dip portion and including a receptacle, said receptacle having a hollow interior and an opening formed therethrough to communicate with said interior;

a second catch located at said bottom portion; and a locking clip having first and second ends respectively engaging said first and second catches, said first end including a U-shaped head having a locking finger projecting therefrom, said head removably received within the interior of said receptacle of said first catch such that said locking finger extends into said opening therethrough for preventing the inadvertent removal of said first end from said first catch.

2. The fastening means for a sink trap recited in claim 1, wherein said second catch includes a tab projecting from said bottom portion, the second end of said locking clip engaging said tab.

3. The fastening means for a sink trap recited in claim 2, wherein the second end of said locking clip includes a base, said base surrounding said tab at said bottom portion.

4. The fastening means for a sink trap recited in claim 1, wherein said first and second catches of said dip and bottom portions are axially aligned with one another.

5. For use with a sink trap having an upper dip portion and a bottom portion detachably connected to said dip portion, fastening means by which to releasably attach said bottom portion to said dip portion, said fastening means comprising:

a hollow receptacle located at said dip portion;

a tab projecting from said bottom portion and axially aligned with said receptacle; and a locking clip having first and second ends and a flat body extending between said first and second ends, said first end having a U-shaped head removably received within said hollow receptacle and said second end having a flat base transversely aligned with said flat body to surround sand engage said axially aligned tab.

6. The fastening means for a sink trap recited in claim 5, wherein said hollow receptacle and said tab are positioned opposite one another adjacent the intersection of said detachable upper dip portion with said bottom portion such that the flat body of said locking clip extends therebetween.

7. The fastening means for a sink trap recited in claim 5, wherein said flat base of said locking clip projects outwardly from said flat body to receive a lifting force by which said base is disengaged from said tab and said U-shaped head is caused to rotate within said receptacle.

8. The fastening means for a sink trap recited in claim 5, wherein said hollow receptacle has an opening formed therethrough, the U-shaped head of said locking clip being received within said receptacle and extending into said opening for preventing the inadvertent removal of said head from said receptacle.

9. The fastening means for sink trap recited in claim 8, wherein said U-shaped head has a locking finger projecting therefrom, said U-shaped head received within said receptacle and said locking finger extending into said opening thereof.

* * * * *